United States Patent [19]

Parker

[11] 3,940,036

[45] Feb. 24, 1976

[54] REMOVABLE POURING SPOUT ADAPTABLE TO DIFFERENT SIZE CONTAINER OPENINGS

[76] Inventor: Marvin Leon Parker, 5936 Ford Court, Brighton, Mich. 48116

[22] Filed: July 2, 1974

[21] Appl. No.: 485,106

[52] U.S. Cl. ..... 222/530

[51] Int. Cl.[2] ..... B67D 3/04

[58] Field of Search ..... 222/188, 569, 527, 479, 222/530, 563, 570, 478; 220/287

[56] References Cited

UNITED STATES PATENTS

| | | | |
|---|---|---|---|
| 2,243,673 | 5/1941 | Henry | 222/530 |
| 3,266,682 | 8/1966 | Schultz | 222/570 |

FOREIGN PATENTS OR APPLICATIONS

| | | | |
|---|---|---|---|
| 371,620 | 4/1932 | United Kingdom | 222/478 |
| 84,504 | 2/1957 | Netherlands | 222/563 |
| 420,283 | 1/1911 | France | 220/287 |

*Primary Examiner*—Stanley H. Tollberg
*Assistant Examiner*—Norman L. Stack, Jr.
*Attorney, Agent, or Firm*—Burns, Doane, Swecker & Mathis

[57] ABSTRACT

A pouring spout for a container of from one pint to one gallon in size, having a discharge opening therein. The pouring spout comprises a tapered plug, such as a stopper, to fit in the opening and has a hole with which one end of an elongated tube is connected for discharge of the contents. The exterior of the plug or stopper is provided with an elongated groove through which air is admitted into the container as liquid is discharged therefrom. The tapered plug or stopper has stepped periphery provided by a series of ribs to cause tight fit engagement with the opening in the container of varying sizes.

4 Claims, 5 Drawing Figures

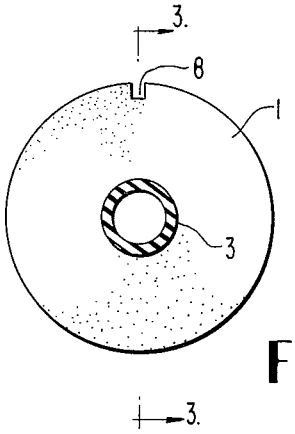
FIG. 2
FIG. 1
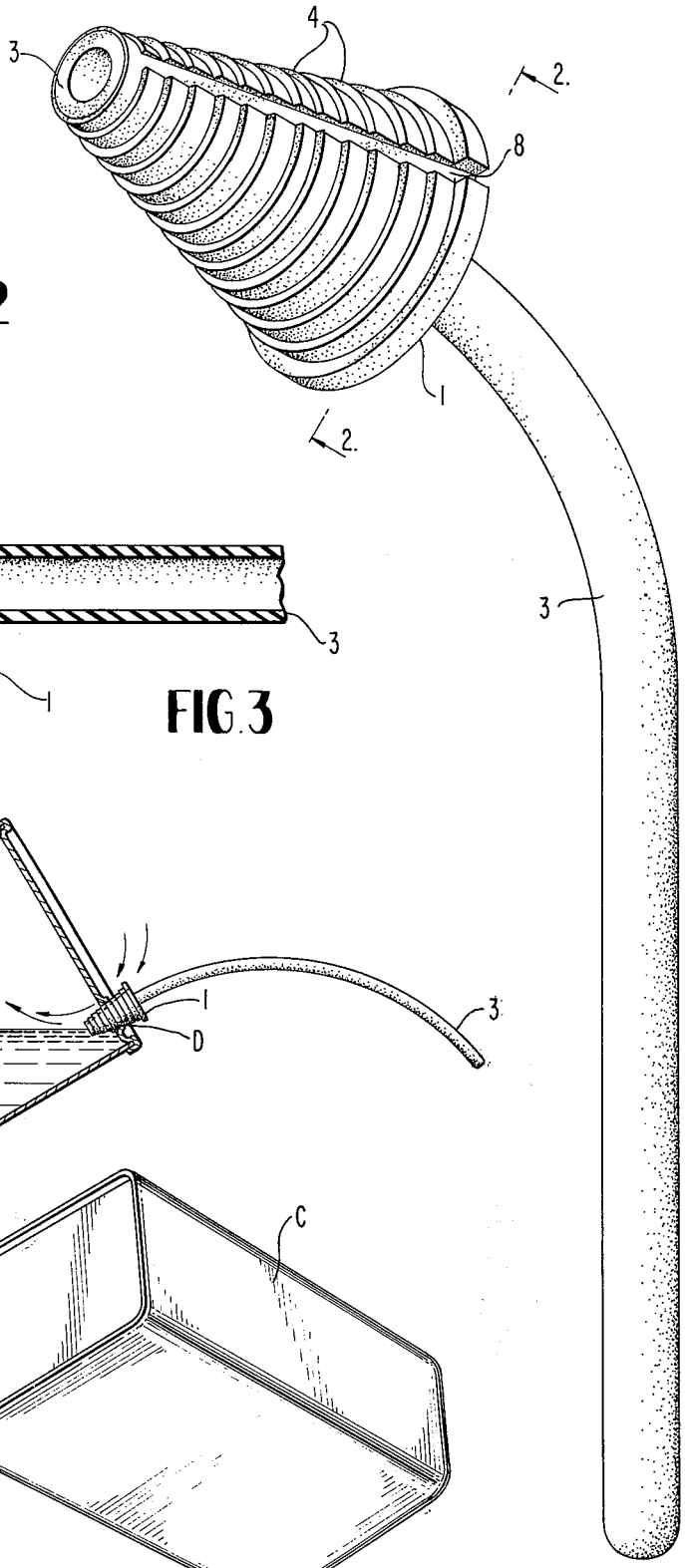
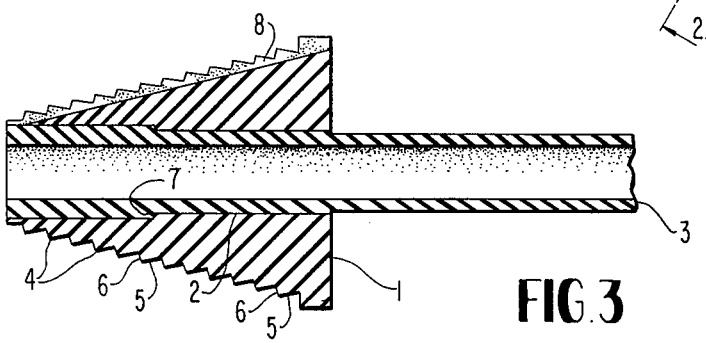
FIG. 3
FIG. 4
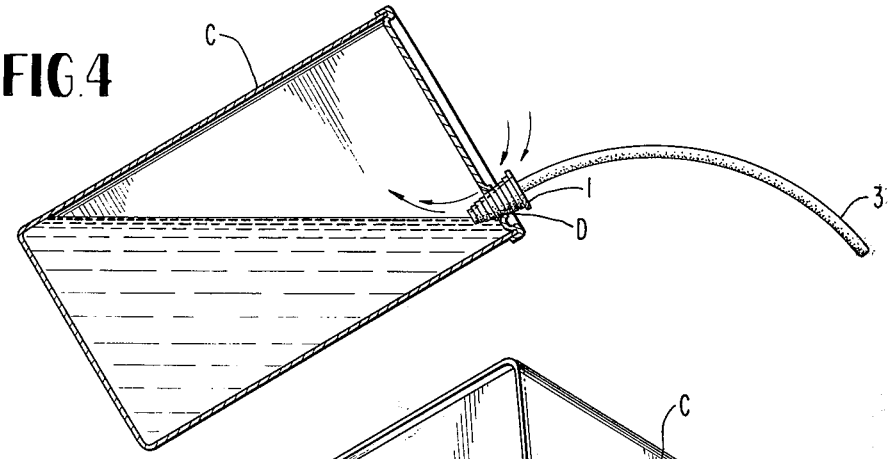
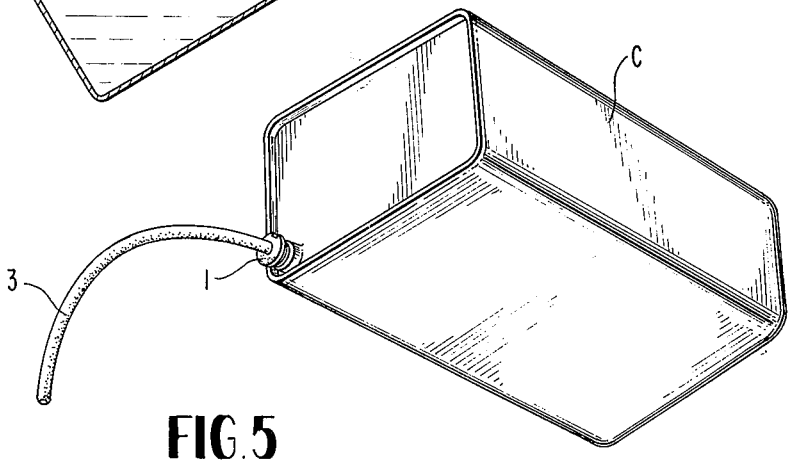
FIG. 5

REMOVABLE POURING SPOUT ADAPATABLE TO DIFFERENT SIZE CONTAINER OPENINGS

RELATED APPLICATION

This is a continuation-in-part of U.S. application Ser. No. 382,341 filed by the present inventor on July 25, 1973.

SUMMARY OF THE INVENTION

This invention relates to pouring spouts for containers, such as cans that contain inflammable liquids.

Many such containers are provided with screw caps which must be removed to discharge the contents from the neck or opening of the container. These containers often are of a capacity of from one pint to one gallon in size and sometimes larger.

Upon removal of the screw cap, the contents must be poured from the opening in the container. Not only is this difficult because of the inadequate length of the neck, but it also entraps air in the container which prevents discharge of the contents.

Various attempts have been made heretofore to provide pouring spouts on such containers, but these usually have required a tube attached to a screw cap which must be made to fit precisely the discharge opening of the particular container, one container only. Not only are such pouring spouts expensive to manufacture and to use, but a pouring spout of this type can be used only on one particular size container since it is not adaptable for a multiple sized opening as usually employed in containers of from one pint to one gallon in size.

One object of this invention is to simplify and improve pouring spouts for the purpose described to enable these to be used on different sized containers and yet to fit accurately the discharge openings thereof.

Another object of the invention is to provide for the simple and effective discharge of the contents from a container which will not only direct the contents out to the desired point of use remote from the container, but also will permit the admission of air into the container to replace the liquid contents discharged.

These objects may be accomplished, according to one embodiment of the invention, by providing a plug or stopper of tapered form capable of being inserted into the discharge opening of a container having a discharge opening of any usual size and to fit therein. The plug or stopper has a hole therethrough for the discharge of the contents, which hole is connected with the inner end of a discharge spout. The contents can be directed through the hole and through the spout as the container is lifted and tilted or inverted.

The plug or stopper has a series of angular ribs extending around the periphery thereof for interlocking engagement with the discharge opening in the container.

The plug or stopper is provided also with a second opening therethrough, preferably in the form of a longitudinal groove in the periphery thereof, so as to admit air into the container when the latter is tilted or inverted to discharge the contents. The air will replace the liquid as it is discharged through the tube.

BRIEF DESCRIPTION OF THE DRAWINGS

This embodiment of the invention is illustrated in the accompanying drawings, in which:

FIG. 1 is a perspective view of the plug or stopper and the tube attached thereto;

FIG. 2 is a cross section therethrough on the line 2—2 in FIG. 1;

FIG. 3 is a longitudinal section through the plug or stopper and portion of the tube, on the line 3—3 in FIG. 2;

FIG. 4 is a longitudinal sectional view through a container having a pouring spout attached thereto; and FIG. 5 is a perspective view of the container and pouring spout.

DETAILED DESCRIPTION OF DISCLOSURE

The pouring spout is adapted for use in connection with containers such as cans for inflammable liquids and other materials, an example of which is illustrated at C, which is usually of a size of from one pint to one gallon in capacity. However, the plug or stopper according to this invention can be made of a size to be used with any size container. The can C usually has a discharge opening D in the top which may or may not have a neck thereon, often covered by a cap of screw type or otherwise.

The pouring spout, according of this invention, comprises a plug or stopper, generally indicated by the numeral 1, which is preferably tapered in length so as to make it adapted to fit in the discharge opening D of different sizes of openings. The plug or stopper 1 has a hole 2 extending lengthwise therethrough from end to end thereof. In the hole 2, the plug or stopper 1 is provided with a discharge tube 3 fitting in the hole 2 for discharge of the contents through the hole and tube when the container C is tilted or inverted (FIGS. 4 and 5).

It is preferred that the plug or stopper 1 and the tube 3 be molded from neoprene rubber yieldable material or from suitable yieldable plastic material as found desirable. The tube should be thin walled and relatively flexible. This affords a simple and inexpensive method of constructing the parts of the pouring spout.

The periphery of the plug or stopper 1, substantially throughout its length, is surrounded by a multiplicity of ribs 4, to interlock with the hole D, according to the size thereof. As shown in FIG. 3, each of the ribs 4 has an outer surface 5 which, in cross section, is at a small acute angle to the axis of the plug or stopper 1, and at a right angle to the lateral side 6 which is at a substantial acute angle to the axis of the plug or stopper. Thus, the tapered sides of the ribs will grip the edges of the opening in the container. These ribs 4 of graduated diameter may be inserted in the opening D to interlock therewith and form a tight seal with the opening. The graduated size of the ribs on the tapered plug will cause the plug or stopper to fit tightly in discharge openings D of varying sizes.

As shown in FIG. 3, the tube 3 extends throughout the length of the plug or stopper 1. An interfitting shoulder 7 retains the inner end of the tube in the plug or stopper 1. The tube 3 can be molded separately from the plug or stopper and passed through the latter to a seated position, the elasticity of the tube permitting such insertion, and retaining it in place.

A groove 8 extends lengthwise of the plug or stopper 1 in the periphery thereof and throughout the length of the plug or stopper. When the plug or stopper 1 is in place in the discharge opening D, as indicated in FIG. 4, this groove 8 will afford a passageway for air to be admitted into the interior of the container C, as indicated by the arrows in FIG. 4, to replace the liquid contents as the latter are discharged through the tube 3. Thus, when the tube 3 is at the lower portion of the container C, the maximum amount of the contents can thus be discharged without being trapped in the container. This will also locate the groove 8 for the passage of air at a point above the liquid level in the tilted or inverted container and assure the admission of sufficient air so as to allow the free flow of the contents in the tilted or inverted position.

By making the structure of the pouring spout, including both the plug or stopper and the tube 3, of neoprene rubber or of other suitable, somewhat flexible or elastic material, such as some of the plastics, the plug or stopper will fit tightly in the discharge opening D so as to prevent spillage of the liquid being poured therefrom. At the same time, the tube 3 is sufficiently flexible to be inserted into an opening in a receptacle for the liquid or to enable the liquid contents of the container to be directed to the desired point for use. This allows an even and steady flow of the liquid from one container to another and prevents substantial loss or spillage of the contents not being thus transferred.

Moreover, after the flow has started out of the container through a longitudinally curved discharge tube, a syphon action occurs to effect increased flow and to allow the container to remain in a condition which will not spill the contents.

While the invention has been illustrated and described in one embodiment, it is recognized that variations and changes may be made therein without departing from the invention set forth in the claims.

I claim:

1. A pouring spout for a container having a discharge opening for pouring liquid contents therefrom, said spout comprising:

a plug having inner and outer ends and an opening therethrough extending from the inner end to the outer end for discharging contents from the container through said plug opening;

said plug having an outer periphery including an air-admitting external groove formed therein to admit air to the interior of the container during discharge of the contents therefrom through said plug opening;

an elongated discharge tube connected at one end with the plug opening to conduct contents from said plug opening;

said plug being formed of yieldable material and having an outer periphery formed by a plurality of circumferentially disposed resilient ribs, said ribs being spaced in a direction from said outer end to said inner end of said plug and being of gradually decreasing size from said outer end to said inner end to define a ribbed periphery which tapers toward said inner end to allow said plug to fit container discharge openings of various sizes, each rib including:

an outer surface extending away from the longitudinal axis of said plug opening in a direction toward said inner end and forming an acute angle relative to the longitudinal axis of said plug opening so as to be compressed by, and in firm engagement with, said container discharge opening when said plug is installed therein; and a lateral side extending at an angle relative to said outer surface for engaging a lip of said container discharge opening to limit the insertion of said plug into said container discharge opening.

2. A pouring spout according to claim 1 wherein each of said lateral sides extends at a right angle relative to its associated outer surface and at an acute angle relative to the longitudinal axis of said plug opening.

3. A pouring spout according to claim 1 wherein said tube extends through said plug and includes a shoulder which engages a projection of said plug to retain said tube in said plug.

4. A pouring spout for a container having a discharge opening for pouring liquid contents therefrom, said spout comprising:

a plug having inner and outer ends and an opening therethrough extending from the inner end to the outer end for discharging contents from the container through said plug opening;

said plug having an outer periphery including air-admitting external groove formed therein to admit air to the interior of the container during discharge of the contents therefrom through said plug opening;

an elongated discharge tube connected at one end with the plug opening to conduct contents from said plug opening;

an elongated discharge tube connected at one end with the plug opening to conduct contents from said plug opening;

said plug being formed of yieldable material, with said outer periphery being formed by a plurality of circumferentially extending resilient ribs, said ribs being spaced in a direction from said outer end to said inner end of said plug and being of gradually decreasing diameter from said outer end to said inner end to define a ribbed periphery which tapers toward said inner end to allow said plug to fit container discharge openings of various diameters, each rib including:

an outer surface for gripping an inner portion of the container discharge opening, said outer surface extending away from the longitudinal axis of said plug opening in a direction toward said inner end and forming an acute angle relative to the axis of said plug opening so as to be compressed by, and in firm engagement with, said container opening when said plug is installed therein, and a lateral surface extending at an angle relative to said outer surface for engaging a lip of said container discharge opening;

said tube extending through said plug and including a shoulder engaging a projection of said plug to retain said tube in said plug.

* * * * *